US007386099B1

(12) United States Patent
Kasper et al.

(10) Patent No.: US 7,386,099 B1
(45) Date of Patent: Jun. 10, 2008

(54) LEAVE COLLIMATOR FOR RADIATION THERAPY

(75) Inventors: Christian Kasper, Hoerlkofen (DE); Michael Weibel, Jonschwil (CH)

(73) Assignee: BrainLAB AG, Feldkirchen (DE)

( * ) Notice: Subject to any disclaimer, the term of this patent is extended or adjusted under 35 U.S.C. 154(b) by 0 days.

(21) Appl. No.: 11/673,858

(22) Filed: Feb. 12, 2007

(51) Int. Cl.
*G21K 1/04* (2006.01)

(52) U.S. Cl. ..... 378/152

(58) Field of Classification Search ..... 378/65, 378/145, 147–152; 250/505.1
See application file for complete search history.

(56) References Cited

U.S. PATENT DOCUMENTS 5,889,834 A 3/1999 Vilsmeier et al. ..... 378/147
6,188,748 B1 * 2/2001 Pastyr et al. ..... 378/151

* cited by examiner

*Primary Examiner*—Courtney Thomas
(74) *Attorney, Agent, or Firm*—Renner, Otto, Boisselle & Sklar, LLP

(57) ABSTRACT

The present application relates to a collimator for radio surgery or radio therapy comprising a plurality of leaves; guiding members for guiding a movement of the leaves; a pressing unit for causing a press contact between the leaves and the guiding members; wherein the pressing unit comprises pressing members which are at least configured to allow for a rolling press contact between the pressing members and the leaves.

16 Claims, 9 Drawing Sheets b)

a)

LEAVE COLLIMATOR FOR RADIATION THERAPY

FIELD OF THE INVENTION

The invention relates to a leave collimator for radiation therapy, in particular x-ray radiation therapy.

DESCRIPTION OF THE RELATED ART

The leave collimators are accessories of linear accelerators (LINACs) that are used especially for irradiating tumors. They were developed to limit the area of radiation, to protect healthy tissues from radiation. These kinds of leave collimators (or "blade collimators") are described in U.S. Pat. No. 5,889,834 which is hereby incorporated by reference. The leave collimator comprises leaves which are movable in order to define the limited area, i.e. to block radiation which is outside the limited area. The limited area has for instance the same or similar shape as a tumor which is to be treated by the radiation. The leaves are generally of a radiation blocking material. In case of x-ray radiation, the material is e.g. of tungsten or lead. In order to form the limited area, the leaves have to be moved into particular positions. In order to achieve a modulation of the amount of radiation delivered to the tissue, the leaves have to be moved during radiation treatments. In order to reduce noise caused by the leaves and to allow for a exact positioning of the leaves, it is preferable that the play or clearance of the leaves which the leaves have in relation to guiding members is reduced to a minimum. In order to achieve this, according to the prior art, spring plunger screws are used which press against an upper edge of a leave in a direction perpendicular to the movement of the leaves. The spring plunger screws are screwed into screw openings provided in the top of a casing for accommodating the leaves. The lower end of the casing comprises guiding members for guiding the edges opposing the edges which contact the spring plunger screws. A plurality of spring plunger screws have to be adjusted individually for each leave in order to achieve the desired pressing force which usually is in a range between 0 and 2.5 N per spring plunger screw. In order to increase the pressing force, in particular for thicker and therefore heavier leaves, two spring plunger screws have to be used.

SUMMARY OF THE INVENTION

The inventors of the present invention have found that the contact between the spring plunger screws and the leaves may cause abrasion and wear which in turn may cause an increased frictional force during movement of the leaves or even a blocking of the movements.

The object of the invention is to increase the lifetime of use of a leave collimator, the leaves of which have to be moved often during usage. Another object is to reduce the risk of sticking of the leaves when they are moved.

The aforementioned object is solved by a collimator according to the invention, in particular as mentioned in the claims. According to the present invention, the collimator for radio surgery or radio therapy comprises a plurality of leaves; guiding members for guiding a movement of the leaves; a pressing unit for causing a press contact between the leaves and the guiding members; wherein the pressing unit comprises pressing members constituted to allow for a rolling press contact with the leaves. In particular, the pressing unit is constituted such that the pressing members are in rolling press contact with the leaves, if a force, which is applied from the leaves to the pressing members due to their movement, is above a certain threshold. That is, additionally to the rolling press contact, there may also be a frictional contact between the pressing member and the leaves. This frictional contact assists in maintaining the positions of the leaves.

The inventors have found that by allowing for a rolling press contact between the leaves and the pressing unit, the effect of a wear or abrasion (due to frictional contact) may be reduced and the lifetime of usage of a leave collimator may be increased. The rolling press contact is a contact where a pressure is applied from the pressing members to the leaves while the pressing member may rotate or roll due to the force acting between the pressing members and the leaves and due to the movement of the leaves. As mentioned above, a rolling press contact is at least achieved if a force of a certain strength is applied from the leaves to the pressing member. This results essentially in a replacement of the frictional contact by the rolling press contact when the force applied from the leaves to the pressing members increases (from below the threshold to above the threshold). This reduces abrasion since abrasion increases with the increase of frictional force.

According to one embodiment of the invention, spring loaded roller bearings may be used in order to achieve the rolling press contact between the pressing members and the leaves. If the roller bearing are used, the balls of the roller bearings represent the pressing members and there will be nearly no frictional contact. According to another even more preferred embodiment, the pressing unit comprises roller members like balls or cylinders as well as holding members, for holding the rolling members at predetermined position or within a predetermined path. For instance, the holding members may be recesses, holes or long holes which accommodate the rolling members, e.g. balls. The cavities, like long holes, holes or recesses are preferably formed such that the rolling members are blocked to move oblique or perpendicular to the moving direction of the leaves. Thus, according to this embodiment, and contrary to the roller bearing, there will be a frictional contact between the balls and the holding members and additionally between the balls and an elastic member (see below), therefore a greater force is necessary in order to cause a rolling of the rolling members than in case of the roller bearings. The advantage is that the leaves keep their position even in case of vibrations. Furthermore, the space required by such a kind of pressing member is smaller than in the case of using a roller bearing. In addition to the holding members which may be formed in an upper part of a casing for the leaves, an elastic member like elastomers (e.g. rubber) or a spring is preferably provided above the rolling members in order to press the rolling members towards the leaves (preferably up-down direction). This pressing results in a static friction between the rolling member and the leaves. If the leaves are moved, this frictional contact results in a rolling or rotation of the rolling members, in particular if the rolling members are held in position by the holding members while the leaves are moving. The rolling member may have for instance a cylindrical shape with the axis of the cylinder at least perpendicular to the moving direction of the leaves for rolling on its shell surface in contact with the leaves or may be for instance balls. Preferably, the rolling members have a rotational symmetry, wherein the axis of symmetry is at least substantially perpendicular to the moving direction of the leaves and preferable at least substantially perpendicular to the direction of the pressing force between the leaves and the rolling members. For instance, the rolling members may also have a double cone shape or the shape like the wheels of a railroad train while the edges of the leaves are formed like railroad tracks. If balls are used for rolling members and if the holding members comprise mating cavities for the balls, this allows for an easy assembly process since the balls simply fall into the mating cavities (holes) and have not to be aligned with respect to the direction of the movement of the leaves.

Preferably, the pressing unit comprises an elastic unit which in turn may comprise the above-mentioned elastic member. Preferably, the elastic unit comprises a plurality of elastic members for spring loading the rolling members. According to one embodiment a sheet of an elastomer is provided in contact with all rolling members and allows to spring load all rolling members. In particular, the elastomer may be formed like a sheet member. According to another preferred embodiment, a separate elastic member is provided for each of the rolling members. In particular, the elastic members may be spring fingers which extend substantially perpendicular to a direction of the pressing acting from the rolling member onto the leaves and/or extending substantially parallel to the direction of movement of the leaves. The term "substantially" used herein, and in particular in the claims, with respect to direction or orientation means in particular that any deviation within ±30°, more preferably within ±20° and even more preferably within ±10° is covered. Preferably, the surface of the elastic member has a low frictional coefficient like a smooth surface of steel or iron in order to allow for a sliding contact between the rolling members and the elastic members. Preferably, the rolling members have a hardness, which is greater than the hardness of the leaves. Preferably, the rolling members are made of a ceramic (e.g. silicium nitride Si3N4) or hardened steel or (hardened) tungsten. Preferably the frictional coefficient between the rolling members and the elastic members is lower than the frictional coefficient between the rolling members and the leaves. Preferably, the allowable deviations of the balls from a spherical shape are small. Preferably, this deviation described as grade is in the order of Gd25 (15 μm) or the deviations are smaller.

Preferably, the elastic unit has a connecting frame or connecting base which connects the plurality of elastic members, in particular spring fingers with each other. Preferably, the connecting frame or connecting base is fixable to the holding member which accommodates the pressing members in order to achieve a fixed spatial relationship between the pressing members and the elastic members.

Preferably, in order to use the available space most effectively, the rolling members are arranged along a zigzag line. Preferably, the spring fingers are arranged in two groups, one group extending substantially in the same direction as the movement of the leaves, the other group extending substantially in the direction opposite to the direction of movement of the leaves. The extension of the spring fingers starts from the connecting base or the connecting frame. The connecting frame in particular connects both groups of spring fingers and surrounds the spring fingers like a frame. According to an alternative embodiment, the spring fingers extend from a middle bar (which is substantially perpendicular to the moving directions of the leaves) as shown in FIG. 9*b*).

Preferably, the spring fingers are arranged in one plane. In particular, the spring fingers and the connecting frame or connecting base constitute together a spring sheet. The spring sheet may be in particular produced by a punching process. According to an alternative embodiment, the spring fingers are cranked and the cranked portions of the spring fingers represent the pressing members which contact the rolling members and press the rolling members against the leaves.

Preferably, support members are provided. The support members and the holding member preferably sandwich the elastic unit, in particular the spring sheet in between. In particular, the support members support a part of the spring members, in particular spring fingers, i.e. that part which adjoins the connecting base or connecting frame while another part of the spring fingers, the free end part, remains unsupported. The pressing force may be varied by providing support members of different widths.

In order to decrease the wear and/or abrasion, preferably a lubricant is provided. So far, lubricants have not been used for collimators since it was believed that lubricants are not suitable for collimators which are subjected to x-ray radiation. In particular, there was a fear that the lubricant becomes sticky and impedes the movement the leaves. However, the applicant has found that a radiation resistant lubricant allows to reduce the wear and abrasion and improves the lifetime of a collimator. Preferably, the viscosity of the lubricant does not change if the lubricant is subjected to radiation of an amount which is usual for radiation therapy. According to a further embodiment, a lubricant may be used in those parts of the collimator which are protected from radiation due to radiation blocking members. The radiation blocking member may be provided on top of the guiding members to block the radiation. Furthermore, the leaves may act as radiation blocking members and the lubricant may be used between the lower guiding member (below the leaves) and the leaves.

In order to increase the lifetime of the collimator, furthermore, preferably, the surface of the guiding members and/or the leaves, at least those parts of the leaves which contact the guiding members and/or the pressing unit is hardened by a surface hardening process, e.g. by using a layer or coating having diamond-like properties. For instance, polycrystalline diamond layers or amorphous carbon-hydroxide coatings may be applied onto the guiding members or leaves or the pressing unit, in particular the pressing members. The amorphous carbon-hydroxide coatings may be for instance deposited by using plasma deposition of e.g. a plasmarized methane gas. In particular the coatings or layers allow for hardening the surfaces in order to reduce wear and abrasion.

Preferably, the guiding members comprise rounded edges, in particular at the end of the guiding members. Preferably, a rounded chamfer is provided at the end of the guiding members. Preferably, the edges of the leaves have a shape which is rounded. In particular, the contact surface of the edges has a shape which is in mating correspondence to the contact surface of the rolling member. Preferably, the edges of the leaves in contact with the pressing members are formed as grooves, in particular V-shaped or U-shaped grooves which may accommodate the pressing members, in particular ball-like pressing members, in a mating manner. In particular the pressing members can roll along these grooves. Alternatively, the guiding members may have a bar-like shape.

BRIEF DESCRIPTION OF THE DRAWINGS

In the following preferred embodiment the present invention is described. When describing the preferred embodiment, further features and advantages of the present invention as well as alternative embodiments or alternative solutions will be disclosed which are part of the present invention. Same reference signs indicate same parts throughout in the figures.

DETAILED DESCRIPTION OF PREFERRED EMBODIMENT

Figure 1:
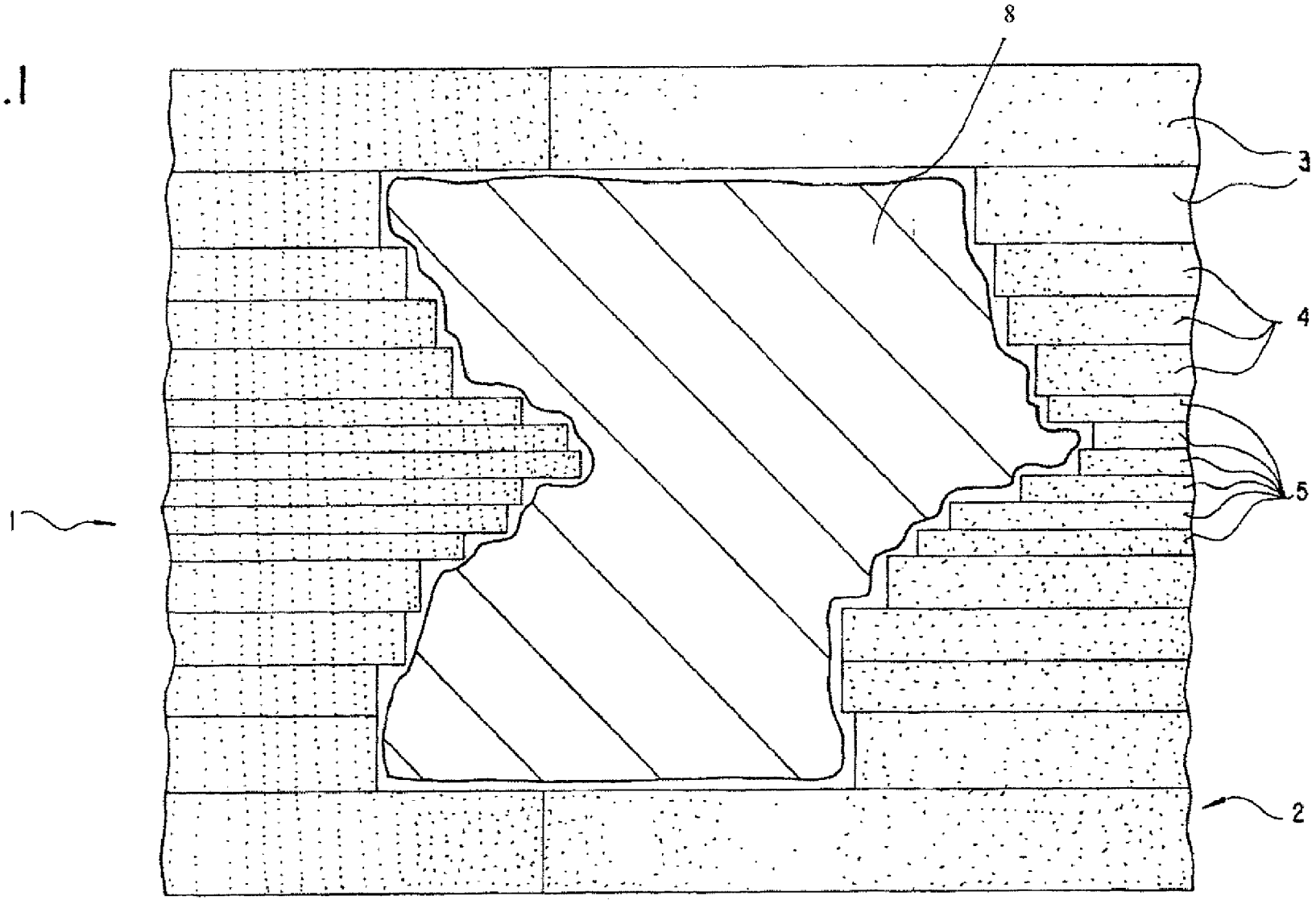
FIG. 1 is a top view to an arrangement of leaves which encompass a tumor.

FIG. 1 shows a left side of leaves 1 and a right side of leaves 2. At the top and at the bottom a left side leave and a right side leave contact each other. The leaves encompass a limited area within which a tumor 8 resides. The leaves have different widths. The width of the leave 3 is larger than the width of the leave 4 and the width of the leave 4 is larger than the width of the leave 5.

Figure 2:
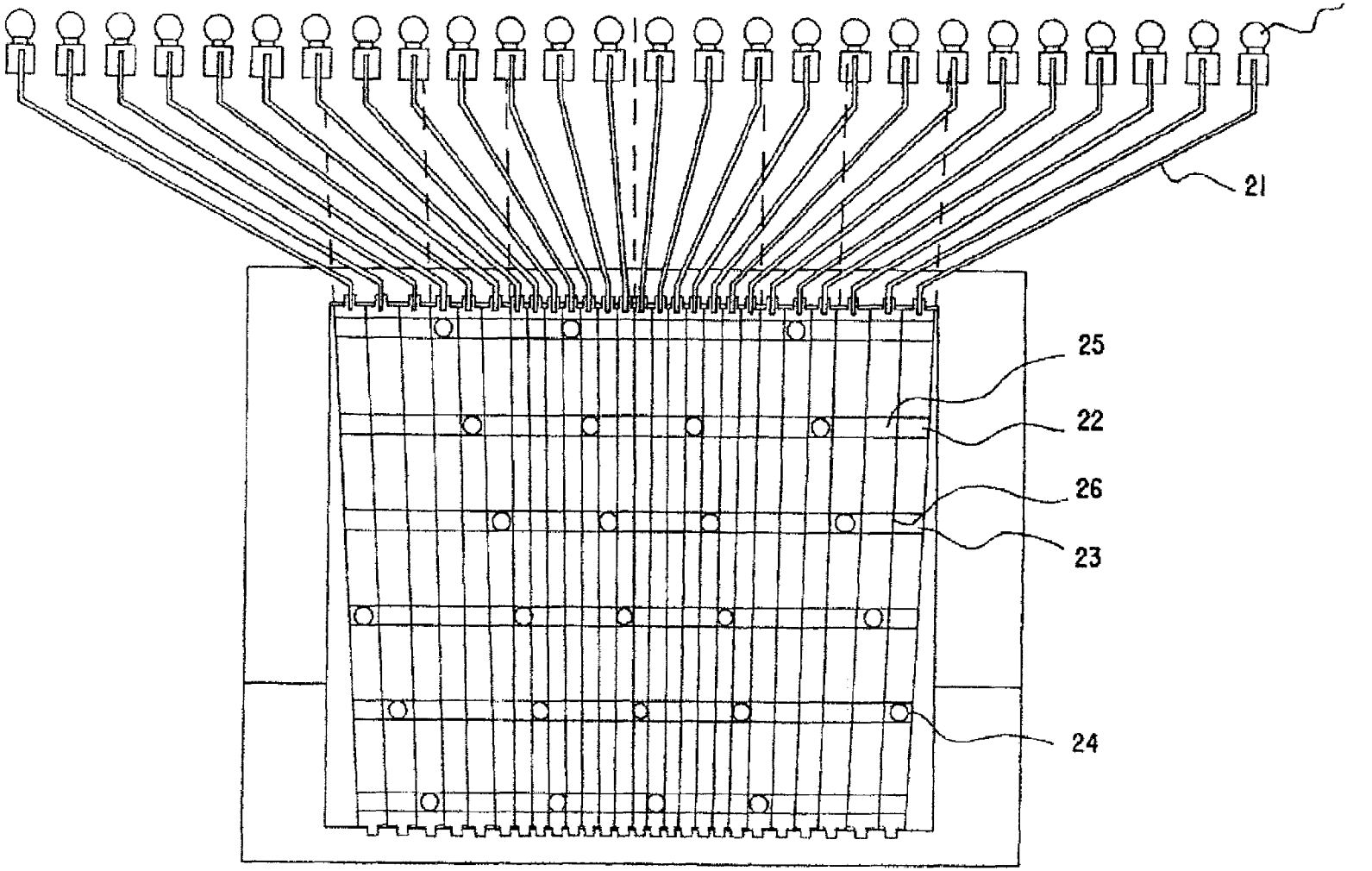
FIG. 2 shows a side view of a collimator.

FIG. 2 shows a side view of a leave collimator. FIG. 2 shows a view of a set of leaves belonging to a collimator according to the invention in the direction of travel of the leaves with connecting strips 21 that engage a position measurement device and are mounted on the upper side of the leaves.

In the leave collimator depicted here, oblong connecting cords 21 are mounted on the upper edges, toward the rear, of the individual leaves; the other ends of these connecting cords engage the rods of a secondary position measurement device, which is not shown, via a mechanism such as a ball connector 27. Seen from the direction of travel of the leaves, the connecting cords 21 spread out upwards in roughly a fan shape to meet contact points on the rods, which are more widely separated than the leaves. The connecting cords 21 consist of flat metal strips that bend in their course from the edges of the leaves to the contact points on the rods of the position measurement device (the bend runs perpendicular to the plane of the drawing and is therefore not visible); the end segments of these strips are straight.

One method of connecting the lower ends of the metal strips to the leaves is by soldering.

FIG. 2 also shows that the leaves, as seen from the direction of travel, exhibit from top to bottom a cross-sectional shape with widened sections 23 on both sides of the bisecting line of the individual leaves, as well as matching narrowed sections 22. In each case, the adjacent, identically shaped leaves have their widened sections 25 and narrowed sections 26 at corresponding, longitudinally displaced sites such that the side faces of the leaves nestle against each other in essentially flat contact. Tapped holes 24 as counterparts to a drive-threaded rod are found in the widened cross-sectional areas of each leave. They can be relatively wide in diameter and therefore accommodate stable threaded rods.

Figure 3:
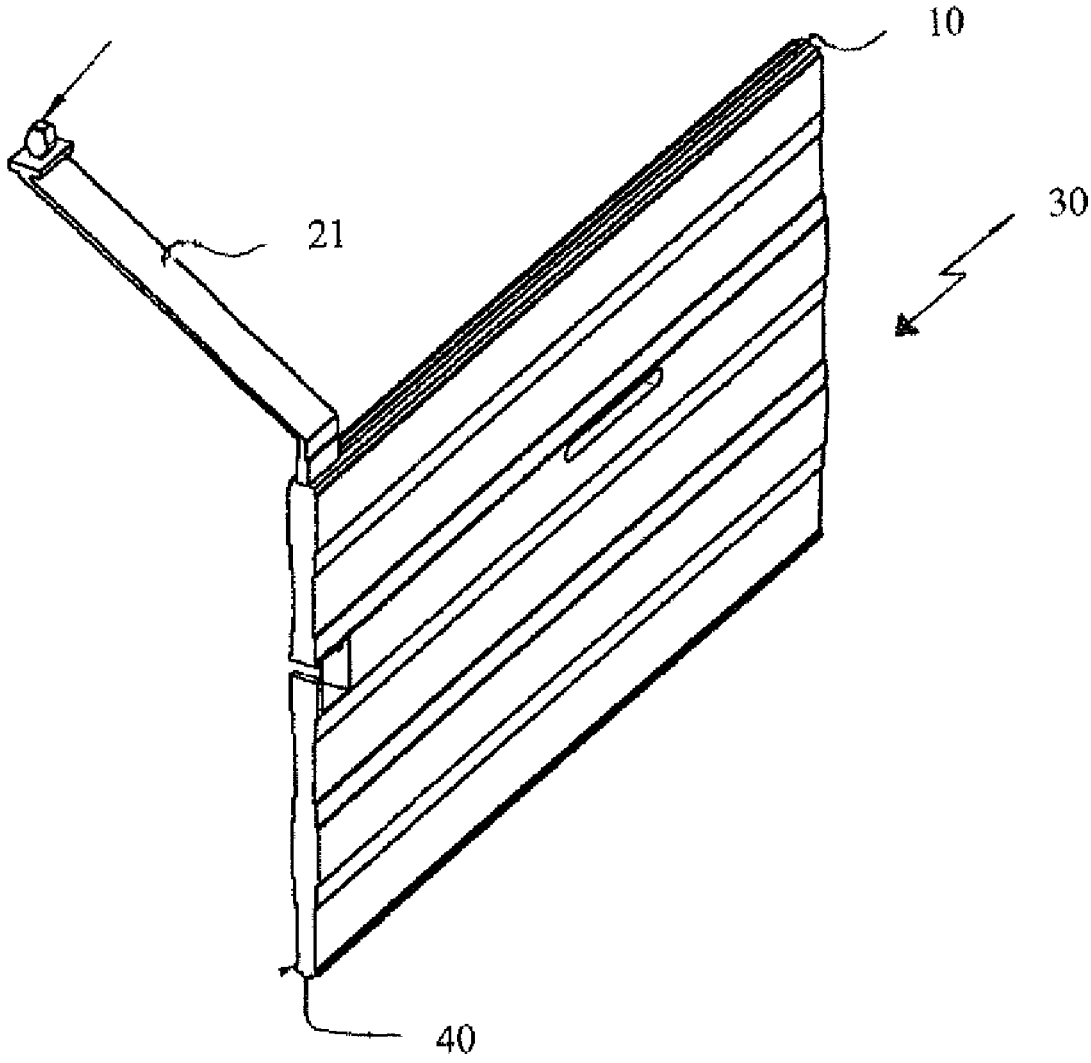
FIG. 3 is a perspective view of a single leave.

FIG. 3 is a perspective view of a leave. The connecting cord or transmitter 21 is provided. At the upper end of the leave, there is a edge 10 which has a bar-like shape. The bar extends in the direction of movement of the leave 30. The lower edge 40 of the leave also has a bar-like shape which extends along the moving direction of the leave.

Figure 4:
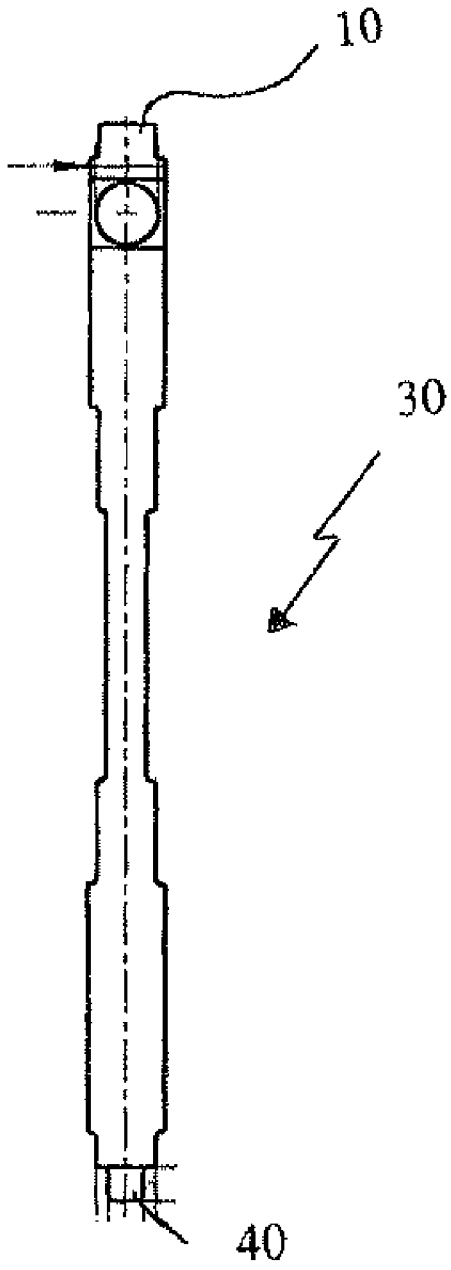
FIG. 4 is a side view of a single leave.

The above described upper and lower edges 10 and 40 can be seen clearly in FIG. 4. The edges 10 and 40 come into contact with a guiding member provided in a casing of the collimator.

Figure 5:
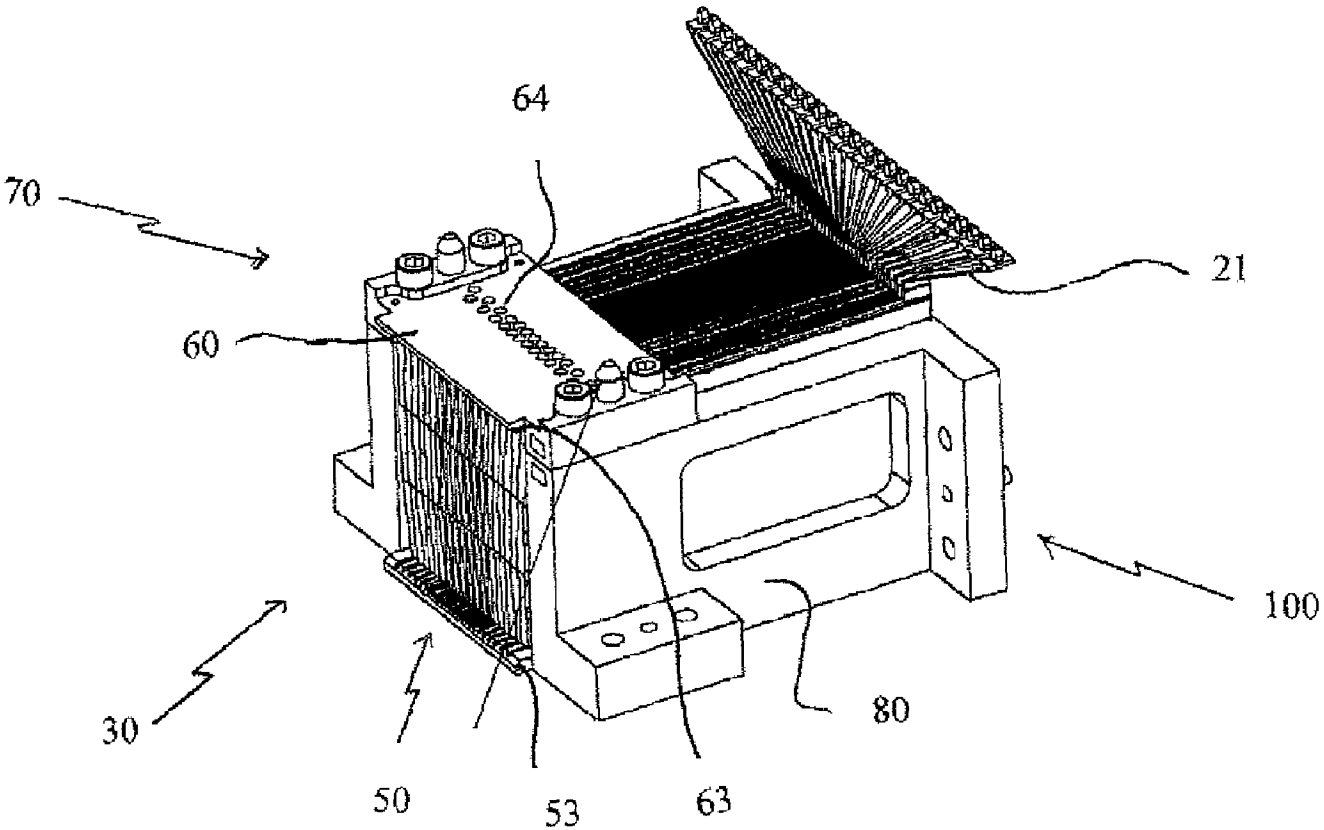
FIG. 5 is perspective view of a collimator.
Figure 6:
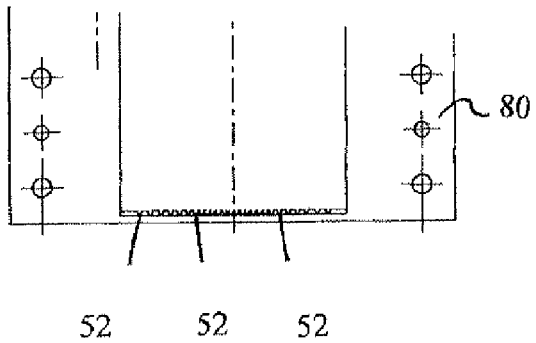
FIGS. 6*a*) and 6*b*) are a perspective view and a side view of a lower casing part, respectively.
Figure 6:
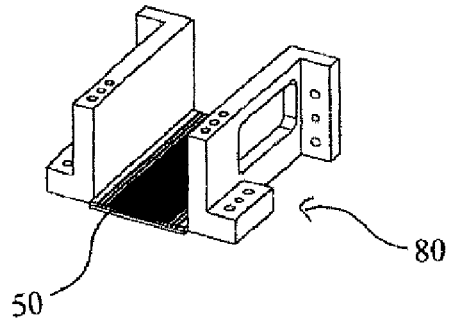
Figure 7:
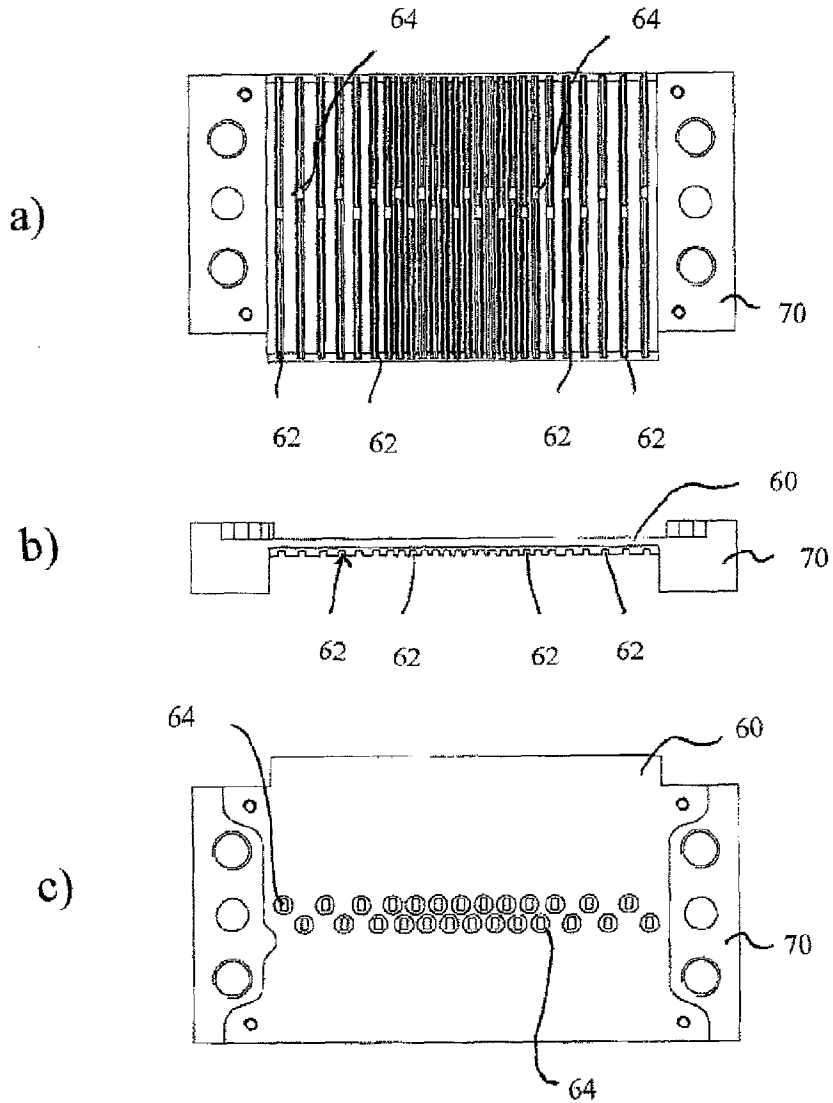
FIGS. 7*a*), *b*) and *c*) are a bottom view, side view and top view of an upper casing part, respectively.

FIG. 5 shows a collimator of the present invention. The leaves 30 are arranged one besides the other. Each leave is guided by top guiding members 62 (see FIG. 7) and bottom guiding members 50. The lower edge 40 of each leave is in contact with a groove-like guiding member 50 at the bottom and a corresponding groove-like guiding member at the top of the casing 100. The top guiding members 63 are at the bottom of an upper casing plate 60 and are shown in FIG. 7. The upper casing plate 60 belongs to the upper casing part 70 shown in FIG. 7 while the lower casing part 80 is shown in FIG. 6.

As can be seen in FIG. 5, there are cavities or holes 64 provided in the upper casing plate 60. These holes 64 are for accommodating the balls 66 (see FIG. 8) of a pressing unit as will be explained later.

FIG. 6*a* shows the lower casing part 80 which comprises the lower guiding member 50 having a plurality of grooves 52. The arrangement of the grooves can be seen in FIG. 6*b*.

Some of the grooves have been designated by the reference sign 52. The lower edges 40 of the leaves as shown in FIG. 3 or 4 are meant for engagement or contact with the grooves 52.

FIG. 7 shows the upper casing part 70. FIG. 7*a* shows the side which faces the leaves. FIG. 7*b* is a side view of the upper casing part 70 and FIG. 7*c* is a top view of the upper casing part 70. As can be seen in FIG. 7*b* there are a plurality of guiding grooves 62, some of which are designated by the reference sign 62. The guiding grooves 62 are meant for contacting the upper edges 10 of the leaves 30 as shown in FIGS. 3 and 4. The grooves 62 can also be seen in FIG. 7*a*. The upper casing plate 60 comprises a plurality of (through) holes 64 which are arranged along a zigzag line. The zigzag line is about perpendicular to the moving direction of the leaves. The holes 64 allow for accommodation of balls of the pressing unit. While the upper side of the holes 64 have a circular opening (see FIG. 7*c*), the lower side has a rectangular opening (see FIG. 7*a*) due to a rectangular cross section of the grooves 62. Generally and preferably, the opening and the lower side of the cavities is smaller than the dimensions or diameter of the pressing member in order to prevent the balls from falling if there are no leaves present.

Figure 8:
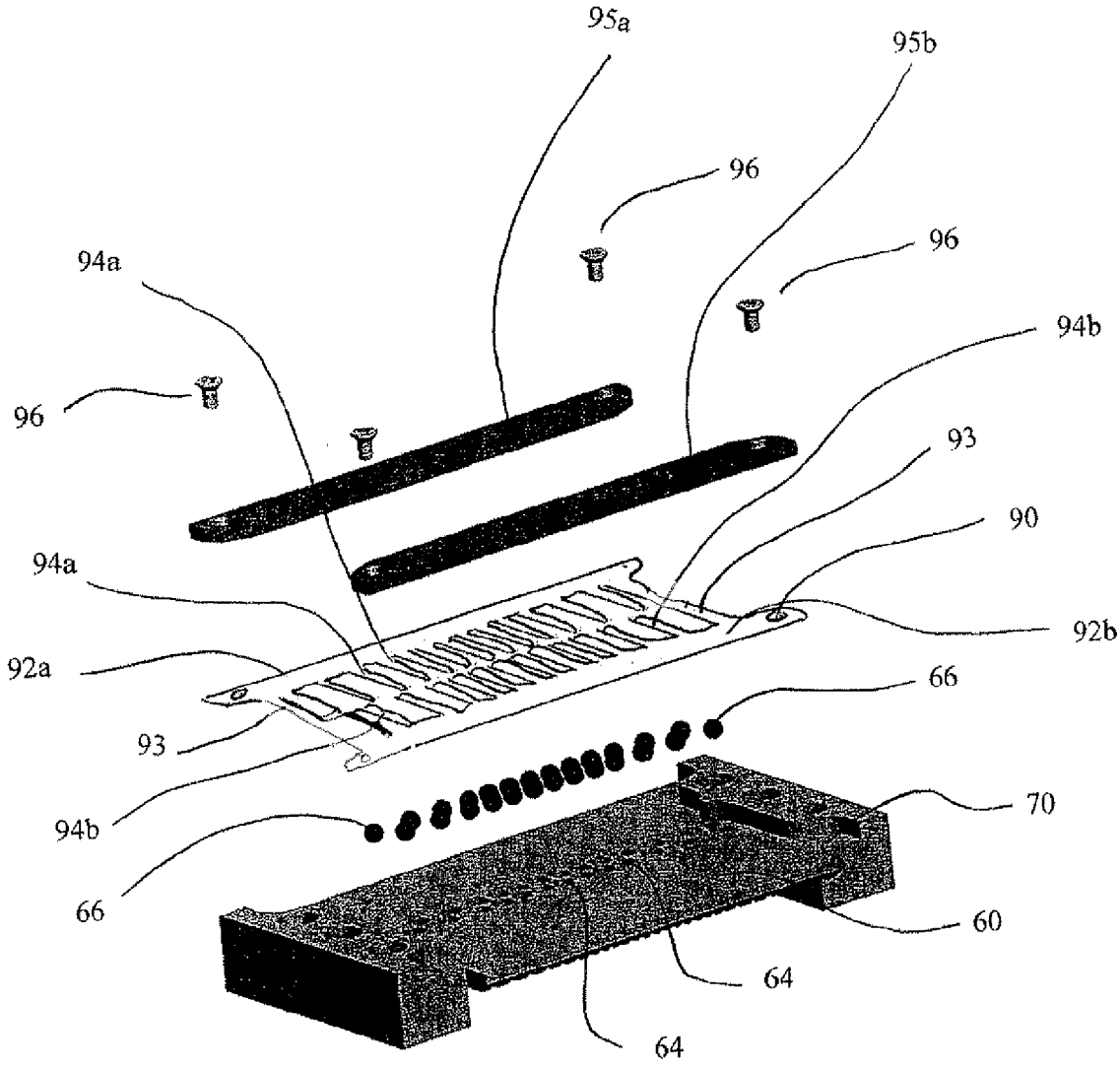
FIG. 8 shows a pressing unit according to the invention.

FIG. 8 is an exploded view of the pressing unit. The upper casing plate 60 comprises the holes 64 for accommodating the balls 66. Thus, the upper casing part 70 and in particular the upper casing plate 60 has a double function. One function is to guide the upper edges 10 of the leaves 30 when the leaves are moving. The second function is to be a holding member, i.e. to hold the balls 66 at predetermined positions and to be an accommodating part, i.e. 1 to provide accommodations, e.g. holes 64 for accommodating pressing members, e.g. balls 66.

In order to achieve a pressing force which acts at least substantially perpendicular to the moving direction of the leaves and, as can be seen from the FIG. 7*c*, substantially perpendicular to the extension direction of the zigzag lines of the holes 64, a spring sheet 90 is provided.

The pressing force is provided by the spring sheet 90. As can be seen from FIG. 8, the spring sheet 90 comprises a plurality of spring fingers 94 which are arranged in two groups a and b. The group a comprises the spring fingers 94*a* and the group b comprises the spring fingers 94*b*. The spring fingers 94*a* extend from a connecting base 92*a* and the spring fingers 94*b* extend from a connecting base 92*b*. The two connecting bases 92*a* and 92*b* extend in parallel to each other and perpendicular to the moving direction of the leaves, in particular parallel to the extension direction of the zigzag line of the holes 64. The zigzag like arrangement of the cavities (holes 64) allows for a more compact design of the collimator as compared to the case when all the cavities are arranged along a line. In particular the leaves may be designed smaller. The two connecting bases 92*a* and 92*b* are bridged by two strings 93 such that the connecting bases 92*a* and 92*b* together with the string 93 constitute a connecting frame. The spring fingers 94*a* and 94*b* have a staggered arrangement and each spring finger is meant for contacting one of the balls 66 which are accommodated in the holes 64. The spring fingers 94*a* extend in a direction starting from the base 94*a* which is opposite to the extension direction of the spring fingers 94*b* which extend from the connecting base 92*b*. Due to the above arrangement, a very compact and space saving pressing unit may be achieved.

The spring sheet 90 is preferably fixed to the upper casing part 70, e.g. by screws. In order to increase the pressing force and/or to improve the fixing of the spring sheets, support members 95*a* and 95*b* may be provided at the top of the connecting bases 92*a* and 92*b*, respectively. As mentioned above, the support members 95*a* and 95*b* may be used to fix the spring sheet 90 to the upper casing part 70, preferably by using screws 96 which pass through the support members 95*a*, 95*b* as well as through the spring sheet 92*a* and 92*b*.

The support members preferably extend substantially along the same direction as the extension direction of the connecting basis 92*a*, 92*b* and/or parallel to the extension direction of the zigzag line of the holes 64. The widthwise direction of the support members 95*a* and 95*b* is preferably at least substantially parallel to the moving direction of the leaves. By selecting support members 95*a* and 95*b* of different width the pressing force of the individual spring fingers may be adjusted. The greater the width of the support members 95*a* or 95*b* is, the greater is the pressing force of the spring fingers 94*a* and 95*a*, respectively supported by the support members 95*a* and 96*a*.

Furthermore, the pressing force of each individual spring finger 94 depends on the thickness or width of the spring finger 94. Thus, by selecting appropriate thickness or width of the spring fingers 94, for each leave an individual pressing force may be selected. Since the leaves differ in thickness and therefore in weight, preferably, a larger pressing force is selected for leaves having a heavier weight.

The pressing force is preferably greater than 0N, in particular greater than 0.1N, in particular greater than 1N and preferably lower than 10N, in particular lower than 5N.

Preferably, the support members 95*a* are arranged to cover that part of the spring fingers which is connected with the connecting base but the support members do not cover the free end of the spring fingers. Depending on the amount of coverage, the pressing force of the spring fingers may be adjusted or selected. In particular, the width of the support members 95*a* and 95*b* may vary along the lengthwise extension of the support member such that the coverage of the spring fingers varies along the lengthwise extension direction. Thus, the pressing force may vary along the lengthwise extension direction.

When the balls 66 are housed by the holes 64 and pressed by the spring sheet 90 towards the edges 10 of the leaves 30 and when the leaves are moved, this results in a rotation of the balls 66 due to the pressing contact between the balls and the upper edges 10 of the leaves (if the frictional contact between the balls 66 and the upper casing plate 60 as well as the spring fingers has been overcome). In this way, the abrasion of the upper edges of the leaves and of the pressing members may be reduced compared to the prior art solution. Furthermore, the lifetime may be increased. Alternatively or additionally, the lifetime may be increased by providing a lubricant in particular at those parts of the collimator where there is a contact between the guiding grooves and the edges of the leaves or between the pressing members (balls) and the edges of the leaves.

It is of advantage for the lifetime if there is a rounded chamfer 53, 63 (see FIG. 5) at the lengthwise end of the upper and lower guiding members (grooves 52 and 62).

Figure 9A:
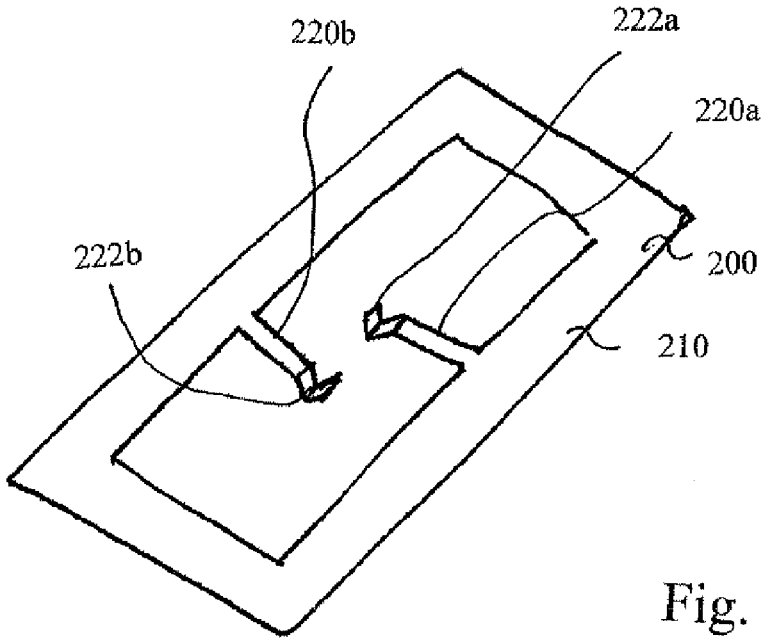
FIGS. 9*a* and *b* show alternative embodiments for a spring sheet.

FIG. 9*a* shows an alternative solution of a spring sheet 200. The spring sheet 200 comprises a frame 210. From the frame towards the inside, there extend spring fingers 220*a* and 220*b*. At the free end of the spring fingers there are cranked portions 222*a* and 222*b* which are cranked towards the leaves in order to contact the rolling members and to press the rolling members towards the leaves.

Figure 9B:
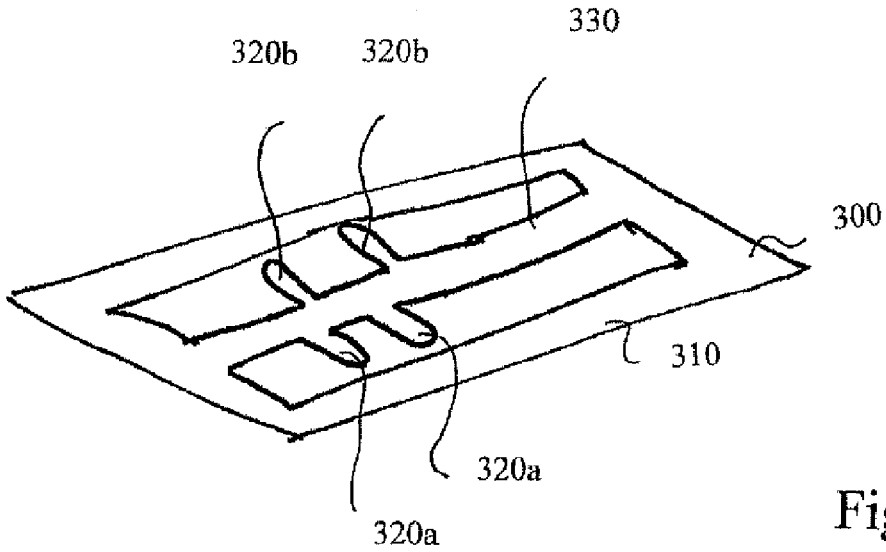

FIG. 9*b* shows another alternative embodiment for a spring sheet 300. The spring sheet 300 comprises a frame 310 and a middle bar 330 which runs substantially perpendicular to the leaves. From the middle bar 330 there are extending spring fingers 320*a* and 320*b*. The spring fingers 320*a* extend in a direction opposite to the extension direction of the spring fingers 320*b*. The spring fingers press against the rolling members in order to press the rolling members towards the leaves.

The invention claimed is:

1. Collimator for radio surgery or radio therapy comprising a plurality of leaves;

guiding members for guiding a movement of the leaves;

a pressing unit for causing a press contact between the leaves and the guiding members;

wherein the pressing unit comprises pressing members which are at least configured to allow for a rolling press contact between the pressing members and the leaves.

2. Collimator according to claim 1, wherein the pressing member is a rolling member.

3. Collimator according to claim 2, further comprising a holding member for holding the rolling members at predetermined positions.

4. Collimator according to claim 1, wherein the pressing unit is configured to further allow for a frictional contact between the rolling members and the leaves.

5. Collimator according to claim 3, wherein the holding member comprises an accommodating part which comprises cavities for accommodating the pressing members at predetermined positions.

6. Collimator according to claim 1, wherein the pressing unit comprises an elastic unit for pressing the pressing members towards the leaves.

7. Collimator according to claim 6, wherein the elastic unit comprises a spring unit having a plurality of spring fingers extending at least substantially perpendicular to a direction of the pressing performed by the pressing unit.

8. Collimator according to claim 7, wherein the spring fingers extend at least substantially parallel to the direction of movement of the leaves.

9. Collimator according to claim 7, wherein the spring unit comprises a connecting frame or connecting base which connects at least a part of the spring feed fingers with each other.

10. Collimator according to claim 7, wherein the spring fingers are arranged in two groups, one group extending at least substantially in the same direction as the movement of the leaves, the other extending at least substantially in the direction opposite to the direction of the movement of the leaves, said extension of the spring fingers respectively origins from the connecting base or connecting frame.

11. Collimator according to claim 7, wherein the spring unit is sheet-like.

12. Collimator according to claim 7, wherein the pressing unit further comprises support members for defining a pressing strength by supporting at least part of the spring fingers.

13. Collimator according to claim 1, wherein a radiation resistant lubricant is provided between at least one of the following: the leaves and the guiding members, and the leaves and the pressing members.

14. Collimator according to claim 1, wherein the edges of at least one of the lengthwise ends of the guiding members comprise chamfers.

15. Collimator according to claim 1, wherein at least one of the guiding members and edges of the leaves which contact the guiding members have been subjected to a surface hardening process.

16. Collimator for radio surgery or radio therapy comprising a plurality of leaves;

guiding members for guiding a movement of the leaves;

pressing members for causing a press contact between the leaves and the guiding members;

wherein a radiation resistant lubricant is provided between at least one of the following: the leaves and the guiding members, and the leaves and the pressing members.

* * * * *